United States Patent [19]

Lagerlöf

[11] Patent Number: 5,028,891

[45] Date of Patent: Jul. 2, 1991

[54] ARRANGEMENT FOR SUPPLYING POWER TO A HOLLOW WAVEGUIDE INTENDED FOR ELECTROMAGNETIC MICROWAVES

[75] Inventor: Rolf O. E. Lagerlöf, Mölnlycke, Sweden

[73] Assignee: Telefonaktiebolaget L M Ericsson, Stockholm, Sweden

[21] Appl. No.: 472,842

[22] Filed: Jan. 31, 1990

[30] Foreign Application Priority Data

Mar. 14, 1989 [SE] Sweden ..... 8900896

[51] Int. Cl.[5] ..... H01P 5/103

[52] U.S. Cl. ..... 333/26; 333/248; 343/771

[58] Field of Search ..... 333/26, 113, 237, 248; 343/770, 771

[56] References Cited

U.S. PATENT DOCUMENTS

| | | | |
|---|---|---|---|
| 3,189,908 | 6/1965 | Provencher | 343/771 |
| 3,524,189 | 8/1970 | Jones, Jr. | 343/771 |
| 4,429,313 | 1/1984 | Muhs, Jr. et al. | 343/771 |
| 4,801,903 | 1/1989 | Mohr | 333/26 X |

FOREIGN PATENT DOCUMENTS 1054851 11/1983 U.S.S.R. .

1188814 10/1985 U.S.S.R. .

*Primary Examiner*—Paul Gensler

*Attorney, Agent, or Firm*—Burns, Doane Swecker & Mathis

[57] ABSTRACT

A hollow waveguide (1) for electromagnetic microwaves supports an adaptation chamber (2) on one side thereof. The chamber includes a frame structure (7) and a cover member (8) and is provided with an adapter line (11). The hollow waveguide is a ridge waveguide having a longitudinally extending ridge (4). The chamber (2) is connected electrically to an outer conductor (18) of a coaxial line (3), through which the arrangement is supplied with power with an electromagnetic microwave (S). One end (12) of the adapter line (11) is connected electrically to the adaptation chamber (2), whereas the other end (16) is connected electrically to a centre conductor (17) of the coaxial line (3). The ridge waveguide (1) is supplied with power from the adaptation chamber (2) through a transverse slot (19) and emits microwaves to the surroundings through longitudinally extending slots (6). The chamber (2) is of simple construction and requires only little space, and can be readily adapted to a desired wavelength of the microwave (S).

9 Claims, 3 Drawing Sheets

ARRANGEMENT FOR SUPPLYING POWER TO A HOLLOW WAVEGUIDE INTENDED FOR ELECTROMAGNETIC MICROWAVES

TECHNICAL FIELD

The present invention is concerned with an arrangement for supplying power to a hollow waveguide intended for electromagnetic microwaves, said hollow waveguide having a substantially rectangular cross-sectional shape, the power being supplied with the aid of an adaptation chamber, made of an electrically conductive material, and a coaxial line which is connected to said chamber and which has an outer conductor connected electrically to said chamber and a centre conductor.

BACKGROUND PRIOR ART

Microwave antennas which comprise a desired number of mutually parallel hollow waveguides are well known to the art. The waveguides are disposed in close relationship and are provided on their front sides with a large number of short, sequentially disposed slots through which microwave energy is emitted to the surroundings. The slots are uniformly disposed along the hollow waveguides and extend in the direction of the longitudinal axis thereof. One antenna of this kind is described in the U.S. Pat. No. 4,429,313. According to this patent, the rear side of the waveguide is provided with feed waveguides which extend transversely to the waveguide axis. These feed waveguides are operative to supply the hollow waveguides with microwave energy through coupling slots which extend transversely to the waveguide axis. The feed waveguides are provided with lateral projections and energy is supplied through coaxial lines, the centre conductors of which project into respective projections. When supplying power to large antennas, the microwave energy is distributed through several layers of lattice-laid hollow waveguides. The arrangement is relatively bulky and complicated, which is highly disadvantageous in the case of mobile microwave antennas for instance.

The U.S. Pat. No. 3,524,189 teaches a microwave antenna comprising mutually-parallel, slotted hollow waveguides, as described above. The waveguides may be ridge waveguides, the ridge part of which extends in the direction of the waveguide axis and projects into the waveguide. The waveguide is fed through a coaxial line, the centre conductor of which enters the waveguide at its ridge. Although this arrangement is simple, it can be difficult at times to match the impedance of the coaxial line with that of the hollow waveguide, particularly when the waveguide is a ridge waveguide.

DISCLOSURE OF INVENTION

The aforedescribed drawbacks are avoided by a hollow waveguide power-supply arrangement according to the invention. The arrangement comprises a relatively small adaptation chamber which is located on one side of the hollow waveguide and has an adapter line to which power is supplied through a coaxial line. The waveguide is coupled to the adaption chamber through a slot. The arrangement is simple and the impedance thereof can be adapted readily to emit microwaves within a desired wavelength band.

The arrangement has the characteristic features set forth in the accompanying claims.

BRIEF DESCRIPTION OF THE DRAWINGS

Preferred embodiments of the invention will now be described in more detail with reference to the accompanying drawings, in which.

BEST MODE FOR CARRYING OUT THE INVENTION

Figure 1:
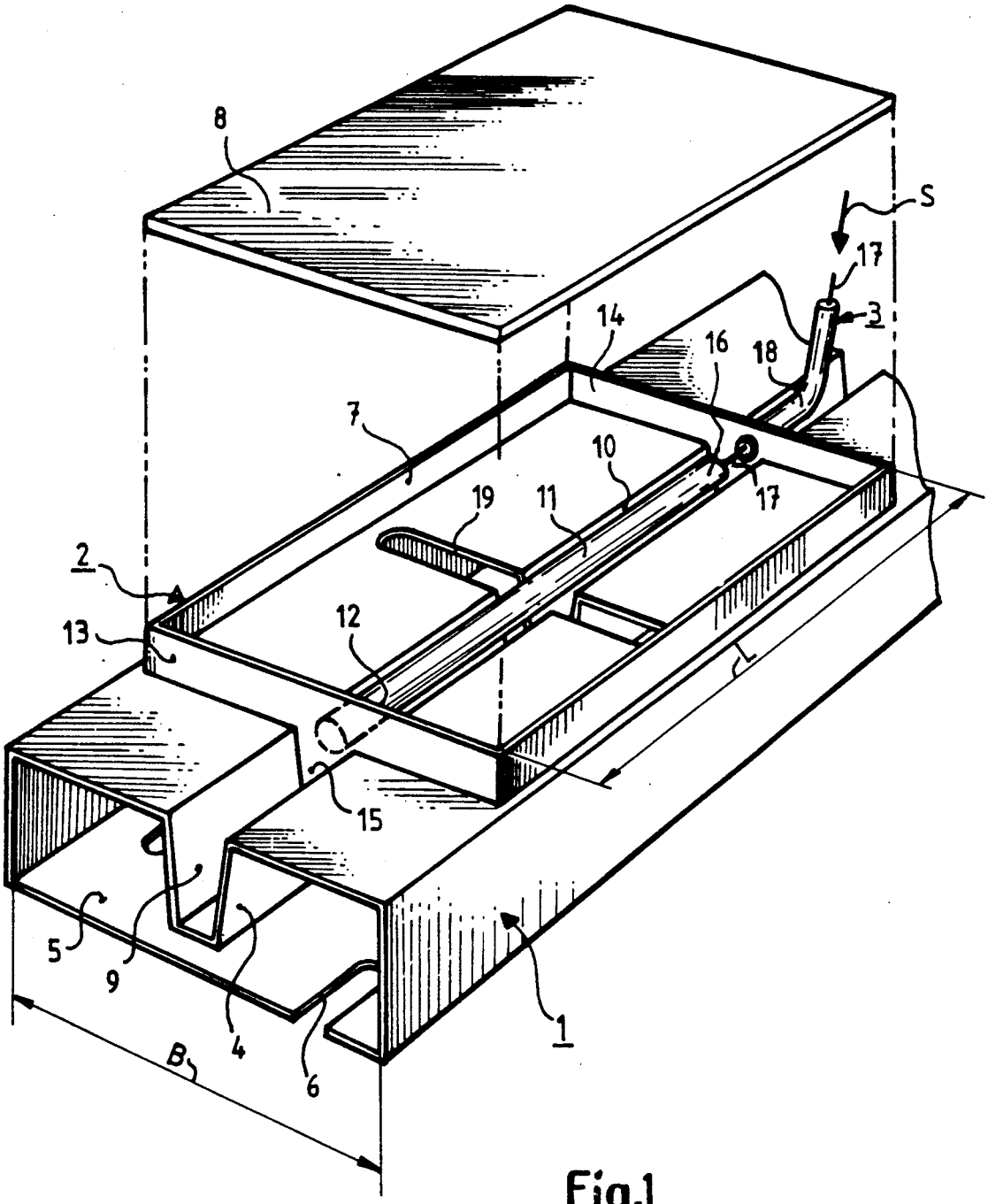
FIG. 1 illustrates one embodiment of the invention in perspective.

The embodiment illustrated in FIG. 1 includes a ridge waveguide 1, which is a hollow waveguide intended for microwaves. The ridge waveguide 1 is made of an electrically conductive material and carries the inventive adaptation chamber 2. The chamber is connected to a coaxial line 3. The ridge waveguide 1 is of known design and has a substantially rectangular cross-sectional shape. The cross-sectional shape deviates from the rectangular by virtue of a ridge 4 which projects into the waveguide and extends in the direction of the longitudinal axis thereof. The ridge waveguide has the advantage of accommodating a relatively large band width of the fundamental mode of a microwave which propagates in the waveguide. Another advantage afforded by the ridge waveguide is that it has a width B which is relatively small in relation to the wavelength of the microwave, e.g. in the order of $B=0.4\lambda$. This can be utilized in the aforesaid type of antenna, which comprises a large number of mutually parallel waveguides packed in close mutual relationship. Because of the relatively small width of the ridge waveguide, it is possible to produce phase-controlled microwave antennas in a known manner. A more detailed description of ridge waveguides is found in the second edition of "Introduction to Microwaves" by Fred E. Gardiol, Artech House 1984. Provided on the flat side 5 of the illustrated waveguide 1, opposite the ridge side thereof, are slots 6 through which the microwave energy is able to radiate to the surroundings. The adaptation chamber 2 is made of an electrically conductive material and comprises a frame structure 7 and a cover member 8. The frame structure 7 is secured to the ridge-side of the waveguide 1 with the aid of tin or soft solder or an electrically conductive adhesive for instance, in a manner such that good electrical connection will prevail between the waveguide 1 and the frame structure 7. For the sake of illustration, the cover member 8 is shown spaced from the frame structure 7, although it will be understood that in the operational state of the arrangement the cover member 8 will be secured to the frame structure, as indicated by vertical broken lines at the corners of said cover member. The walls of the waveguide 1, including the walls of the ridge 4, are thin and a channel 9 extends within the ridge 4, as seen from the outside of the waveguide, axially along said waveguide. This channel 9 forms in the chamber 2 a recess 10 which extends into the ridge 4. End walls 13 and 14 of the frame structure 7 have parts 15 which project down into the channel 9. The adaptation chamber 2 has an elongated electrically conductive adapter line 11, one end 12 of which is connected firmly and electrically to the one framewall 13 of said frame structure. This connection of the adapter line 11 is hidden in FIG. 1 and is indicated in broken lines. The other end 16 of the adapter line 11 is connected electrically to a centre conductor 17 of the coaxial line 3, an outer conductor 18 of which line is connected electrically to the framewall 14. The adaptation chamber is sealed against the surroundings, but communicates with the ridge waveguide 1 through a resonance slot 19 disposed therein. The slot extends transversely to the waveguide axis, across substantially the full width of the waveguide, and also extends through the ridge 4. The adapter line 11 is sunk partially in the recess 10, thereby enabling the height of the adaptation chamber to be maintained at a limited value. It should be noted that in the case of an alternative embodiment, the adaptation chamber 2 can be located on the flat side 5 of the waveguide 1.

As mentioned in the introduction, a microwave antenna may be composed of hollow waveguides, for instance the ridge waveguide 1 illustrated in FIG. 1. A microwave signal S to be transmitted by the antenna is supplied to the coaxial line 3. An electromagnetic wave is generated in the adaptation chamber 2 with the aid of the adapter line 11 and said wave is emitted to the ridge waveguide 1 through the resonance slot 19.

The adaptation chamber has a length L which is contingent on the wavelength $\lambda$ of the microwave signal S in free space and can, for instance, be chosen so that $L=\frac{3}{4}\lambda$. The extension of the resonance slot 19 is also contingent on the wavelength $\lambda$, so that a long wavelength will require a commensurately long extension of the resonance slot. In the majority of applications, the resonance slot 19 will take-up the major part of the width B of the waveguide, and in these applications the width of the chamber 2 will equal the width of the waveguide 1.

The adaptation chamber 2 can be considered to form an extension of the coaxial line 3, although with a significant change in the transverse direction of the conductor in comparison with the coaxial line 3. In this respect, the adapter line 11 corresponds to the centre wave-conductor 17 and the outer conductor 18 is formed by an outer conductor comprising the cover member 8 of the chamber 2, the frame structure 7 and the ridge-side of the waveguide 1. The adaptation chamber 2 together with its adapter line 11 has a characteristic impedance which is dependent on the geometric configuration of the chamber and said line. An appropriate configuration which will provide good adaptation between the ridge waveguide 1 and a microwave source which feeds the coaxial line 3 can be obtained by experimentation for instance.

Figure 2:
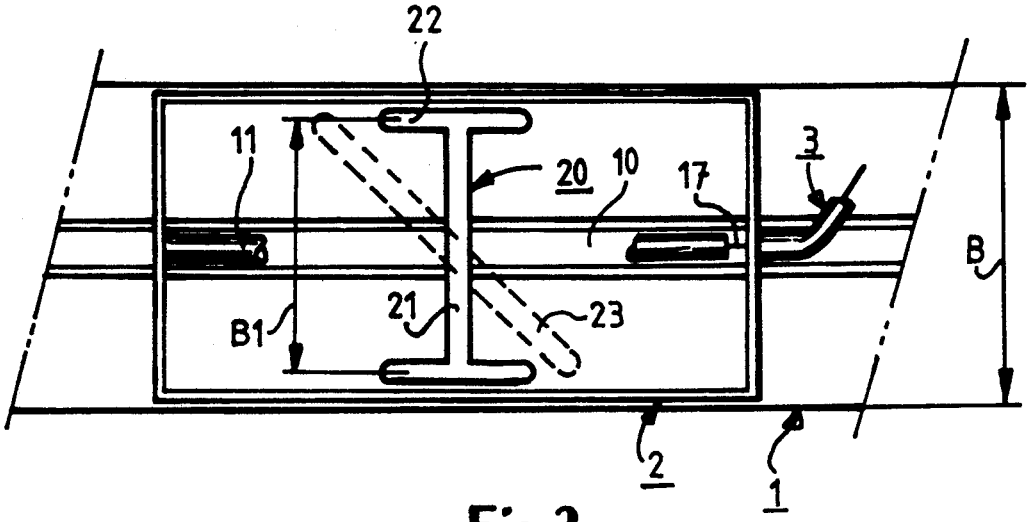
FIG. 2 illustrates a part of the embodiment of FIG. 1, from above.

FIG. 2 illustrates an embodiment of a resonance slot 20 which is intended for use when the wavelength of the microwave signal S is large in relation to the width B. The resonance slot 20 has a first part 21 of length B1 which extends in the transverse direction of the waveguide over substantially the whole width of the waveguide. Located at the ends of the resonance slot 20 are respective slot-parts 22 which extend in both directions parallel to the waveguide axis. The length of the slot-part 22 cannot be readily calculated and is and is established easiest by experimentation. In the case of an alternative resonance-slot embodiment, a slot-part 22 extends in only one direction, parallel to the waveguide axis, from each end of the first part 21. A further resonance-slot 23 is indicated in broken lines in FIG. 2. The slot 23 is straight, but extends obliquely across the waveguide 1 at an angle of, e.g., 45° to the longitudinal axis of said waveguide.

Figure 3:
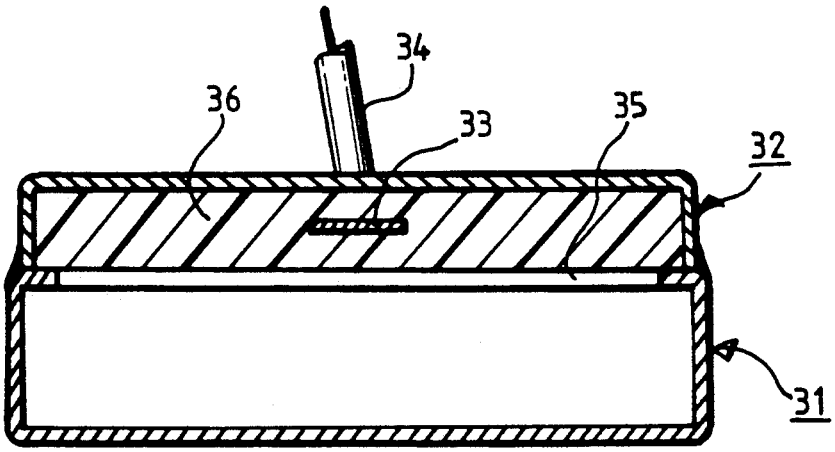
FIG. 3 is a cross-sectional view of a further embodiment of the invention.

An alternative embodiment of the invention is illustrated in FIG. 3, which is a cross-sectional view of a rectangular hollow waveguide 31 having an inventive adaptation chamber 32. The chamber 32 is connected electrically to the waveguide 31 and is closed to the surroundings. An adapter line 33 extends in the chamber 32 in the direction of the longitudinal axis of the hollow waveguide 31.

The adapter line 33 is connected electrically at one end thereof to the centre wave-conductor of a coaxial line 34, in a manner corresponding to that described with reference to FIG. 1. The adaption line 33 is a so-called strip line, and microwave energy in the adaptation chamber 32 is emitted to the hollow waveguide 31 through a resonance slot 35. The adaptation chamber 32 may be filled, either completely or partially, with a dielectric material 36. The adapter line may also have a configuration other than the illustrated circular or strip-line configuration.

Figure 4:
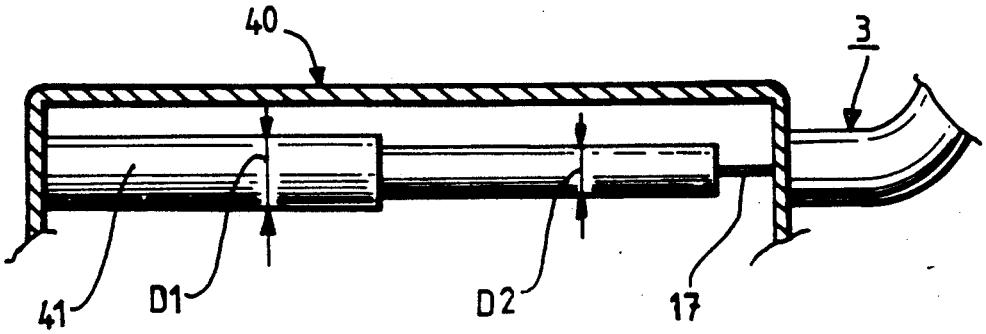
FIG. 4 is a side view of part of the inventive arrangement.

The adapter line illustrated in FIG. 1 is cylindrical and has uniform diameter along the whole of its length. In the case of an alternative embodiment illustrated in FIG. 4, an adaptation chamber 40 includes an adapter line 41 which exhibits a diameter of D1 along a first part of its length and a diameter D2 along a second part of its length. Other embodiments are conceivable, in which the adapter line comprises more than two sections of mutually different cross-sectional dimensions. Adapter lines which exhibit mutually different cross-sectional dimensions along their lengths enable good adaptation to be achieved over a relatively broad frequency range between the hollow waveguide and the microwave source.

Figure 5:
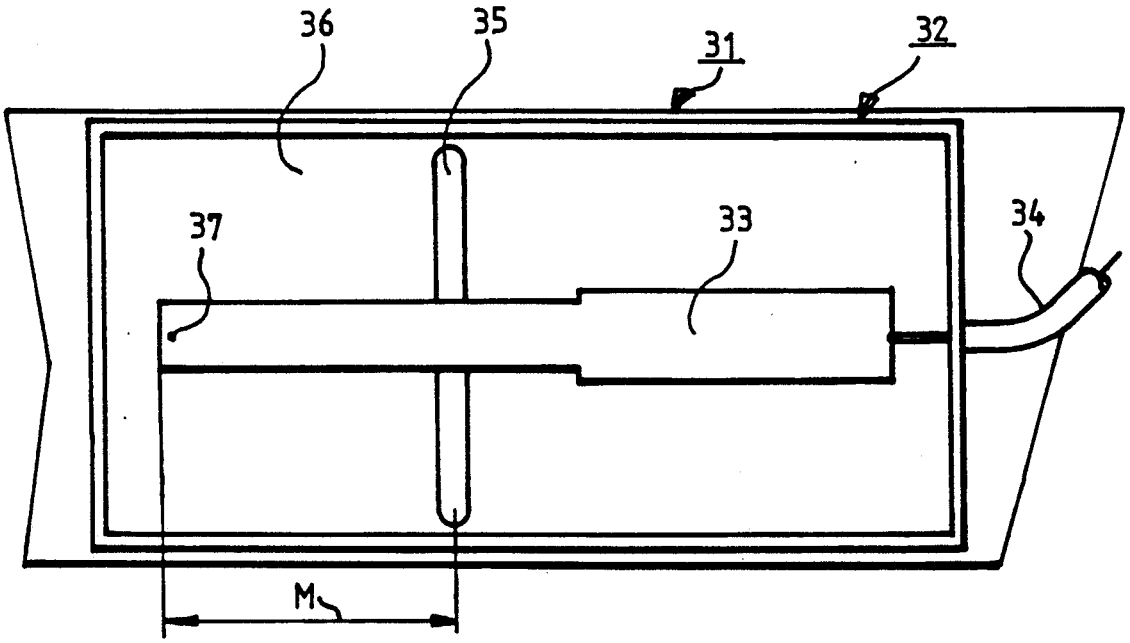
FIG. 5 illustrates the embodiment of FIG. 3, from above.

FIG. 5 shows the adaptation chamber 32 of FIG. 3 from above, with the cover member of the chamber removed. The adapter line 33 is held by the dielectric material 36 and the end 37 of the adapter line 33 is not connected electrically to the wall of the chamber 32. Between said end 37 and the slot 35 there exists a distance M which is equal to approximately one quarter of a wavelength of the microwave in the dielectric material 36. In the case of the FIG. 1 embodiment with a short-circuited adapter line, the corresponding distance is approximately one half of a wavelength.

The aforedescribed inventive adaptation chamber affords several advantages. It is light in weight and requires relatively little space, this advantage being particularly applicable to the embodiment which includes a ridge waveguide. The adaptation chamber can be readily matched to the desired wavelength of the microwave S and it can also be matched to a relatively broad wavelength range. The hollow waveguide may be made of metal, or alternatively of a metallized, plastic-bonded carbon fibre. This material is relatively brittle and problems may arise in securing the coaxial line to the hollow waveguide. This problem is avoided with the inventive adaptation chamber, since in this latter case the coaxial line is secured to the adaptation chamber, which is preferably made of metal.

The ridge 4 of the ridge waveguide 1 illustrated in FIG. 1 does not present true right angles, since the sides of the ridge are inclined to a slight V-shape. This configuration is advantageous from the aspect of the manufacture of hollow waveguides which are produced from plastic-bound carbon fibres, since the ridge 4 will then present a release angle to the tools used in the process of the manufacture.

I claim:

1. An arrangement for supplying power to a hollow waveguide intended for electromagnetic microwaves, said waveguide having a substantially rectangular cross-sectional shape, and the power being supplied with the aid of an adaptation chamber, made of an electrically conductive material, and a coaxial line which is connected to the chamber and which has an outer conductor connected electrically to said chamber and a center conductor, wherein the adaptation chamber is located on one side of the hollow waveguide and extends laterally over at least a part of said one side;

the adaptation chamber communicates with the hollow waveguide through a resonance slot at a frequency of the supplied power disposed in the adaptation chamber, said slot having an elongated portion extending over at least a part of the hollow waveguide in its transverse direction;

an elongated adapted line extends in the adaptation chamber in the direction of the longitudinal axis of the hollow waveguide; and one end of the adapter line is connected electrically to the center conductor of the coaxial line.

2. An arrangement according to claim 1, characterized in that an end of the adapter line remote from the coaxial line is electrically connected to the adaptation chamber.

3. An arrangement according to claim 2, characterized in that the resonance slot extends along at least a part of its length transversely to the longitudinal axis of the hollow waveguide.

4. An arrangement according to claim 1, characterized in that the resonance slot extends along at least a part of its length transversely to the longitudinal axis of the hollow waveguide.

5. An arrangement according to claim 4, characterized in that the resonance slot includes slot-parts which extend in the direction of the longitudinal axis of hollow waveguide from the ends of the part of said slot which extends in the transverse direction of the hollow waveguide.

6. An arrangement according to claim 1, in which the hollow waveguide is a ridge waveguide whose cross-sectional shape deviates from a rectangular shape by virtue of a ridge which projects into the waveguide on one side of the rectangle and which extends along the waveguide in the direction of the waveguide axis, wherein the adaptation chamber is located on the ridge-side of the ridge waveguide; and the adaptation chamber has a recess which projects into the ridge.

7. An arrangement according to claim 6, characterized in that the adapter line extends in the recess projecting into the ridge over at least a part of its extension in the transverse direction of the adapter line.

8. An arrangement according to claim 6, characterized in that the resonance slot includes slot-parts which extend in the direction of the longitudinal axis of the hollow waveguide from the ends of the part of said slot which extends in the transverse direction of the hollow waveguide.

9. An arrangement according to claim 1, characterized in that the adapter line has a circular cross-sectional shape and has separate parts of mutually different diameters along its length.

* * * * *